United States Patent [19]

Seignan et al.

[11] Patent Number: 5,055,241

[45] Date of Patent: Oct. 8, 1991

[54] PROCESS FOR THE PRODUCTION OF PHENOPLAST FIBERS

[75] Inventors: Jacques Seignan, Paris; Bernard Kafka, Rantigny, both of France

[73] Assignee: Isover Saint-Gobain, Aubervilliers, France

[21] Appl. No.: 846,488

[22] Filed: Apr. 1, 1986

Related U.S. Application Data

[63] Continuation of Ser. No. 590,648, Mar. 19, 1984, abandoned.

[30] Foreign Application Priority Data

Mar. 23, 1983 [FR] France ..... 83 04737

[51] Int. Cl.[5] ..... B29B 9/00

[52] U.S. Cl. ..... 264/8; 264/164

[58] Field of Search ..... 264/8, 164

[56] References Cited

U.S. PATENT DOCUMENTS

| | | | |
|---|---|---|---|
| 4,197,063 | 4/1980 | Davidson | 264/8 |
| 4,288,397 | 9/1981 | Snowden et al. | 264/8 |
| 4,294,783 | 10/1981 | Snowden | 264/8 |
| 4,323,524 | 4/1982 | Snowden | 264/8 |

OTHER PUBLICATIONS

Modern Plastics Encyclopedia 1967, Sep. 1966, vol. 44, No. 1A, p. 218.

*Primary Examiner*—James Derrington

*Attorney, Agent, or Firm*—Oblon, Spivak, McClelland, Maier & Neustadt

[57] ABSTRACT

In a process for the production of fibers from phenoplast resins of the resole type, the resin is treated with a cross-linking agent and is immediately thereafter introduced into a centrifuge bushing. The fibers extruded from the bushing are projected into the surrounding atmosphere which is heated so as to accelerate the drying of the fibers before they are collected. The heating is sufficient so that the fibers become solid and non-sticky prior to collecting.

18 Claims, 2 Drawing Sheets

PROCESS FOR THE PRODUCTION OF PHENOPLAST FIBERS

This application is a continuation of application Ser. No. 590,648, filed Mar. 19, 1984, now abandoned.

BACKGROUND OF THE INVENTION

1. Field of the Invention

The present invention relates to a process for the production of fibers from phenoplast resins of the resole type.

2. Description of the Prior Art

The formation of fibers from phenoplast resin is at present a complicated technique having relatively long stages which are difficult to carry out. These techniques are nevertheless employed because they enable products to be obtained which have remarkable fire resistance characteristics.

The phenoplast resins are obtained by the polycondensation of a phenol and an aldehyde. The most commonly used phenoplasts are obtained by the condensation of phenol and formaldehyde. In the description given below, reference will be made mainly to these phenoplast resins based on phenol and formaldehyde, but the characteristics of the invention enable it to be applied to any phenoplast resins, provided they have the properties indicated hereinafter.

Phenoplast resins are conventionally divided into two groups known under the generic terms of "novolaks" and "resoles". These terms serve to distinguish products which differ substantially from one another in their method of preparation, structure and certain properties.

As a simplification, the novolaks may be described as being obtained by a polycondensation in which the phenol is used in excess of the formaldehyde in the presence of an acid catalyst. The resin obtained, which is thermoplastic, may be cross-linked by means of a cross-linking agent such as hexamethylene tetramine or paraformaldehyde in the presence of an acid catalyst. Cross-linking is accelerated by elevation of temperature.

Stated in simplified form, the resoles may be regarded as being obtained by a polycondensation in which the formaldehyde is used in excess of the quantity of phenol, in the presence of an alkaline catalyst. Formation of the resin, which is accelerated by the elevation of temperature, is difficult to control. The end products obtained vary widely according to the operating conditions employed and in particular the duration of the reaction. If the reaction is not stopped, it continues to the formation of a solid product which is infusible and therefore cannot be spun or drawn out. In order to maintain the resin in a workable condition, the reaction should be stopped by a lowering of the temperature and/or the neutralization of the mixture. The resin is then in the form of a solution whose characteristics, viscosity in particular, vary widely according to the degree to which the reaction has progressed. The resin is capable of being cross-linked and such cross-linking may be accelerated in the presence of an acid catalyst. The speed of cross-linking increases with rising temperature.

In practice, only phenoplast resins of the novolak type are at present used for the production of fibers, no suitable techniques being known for the production of fibers from resoles.

Novolak fibers are conventionally produced by melting the thermoplastic resin and then fiberizing the molten resin and treating it with the cross-linking agent and catalyst in an aqueous or gaseous medium.

This treatment resulting in cross-linking is very lengthly since it requires the cross-linking agent and the catalyst to diffuse into the fiber of solidified resin, and it may extend over several hours.

It has been proposed to speed up the treatment by forming the fibers from a mixture of the molten novolak resin and the cross-linking agent. However, the process of cross-linking in an acid, gaseous phase at an elevated temperature under pressure, which in this technique takes place after fiberization, is a delicate operation and difficult to carry out as a continuous process such as is necessary for the production of large quantities under economic conditions.

In the case of resoles, the operation resulting in formation of the fibers in particularly delicate. In contrast to novolaks, for which cooling after passage of the molten mixture through the bushing results in fibers which have to some extent solidified and been individualized even if cross-linking has hardly begun, fiberization in the case of a resole in a state suitable for spinning, that is to say a resole whose reaction has been stopped at a degree of condensation corresponding to a suitable viscosity, results in the production of fibers which are not stabilized but remain glued together.

The invention proposes to provide a process for the production of fibers from resoles.

To achieve this purpose according to the invention, the resin used and the nature and proportions of any added products, in particular a cross-linking catalyst, are chosen to form a mixture whose characteristics, in particular its viscosity, are suitable for the formation of fibers by passage of the mixture through a bushing.

The composition to be fiberized, in which the viscosity conditions may have been adjusted by the addition of solvents, is immediately conducted towards an apparatus comprising a centrifuge and serving as a bushing. The composition introduced into the centrifuge covers the internal peripheral wall of the centrifuge. This wall is perforated by orifices through which the composition passes. The composition is projected from the orifices in the form of fine filaments which are attenuated into fibers and the dimension of the orifices is chosen so that each of them forms a single filament. The conditions determining the kinetics of maturation of the fibers formed, in particular the choice of catalyst and possibly also of the proportions in which it is used, and the temperature conditions of the surrounding atmosphere into which the fibers are projected, are chosen so that the fibers become sufficiently cross-linked and dried in the course of their path through this atmosphere to the apparatus receiving them so that they maintain their own form and do not stick together.

One of the main difficulties encountered in the formation of fibers from resoles is connected with the fact that it is necessary to use highly unstable compositions. This problem does not arise in the case of novolaks. The thermoplastic character of novolaks enables the formation of fibers to take place quite separately from the cross-linking of the resin. In the production of novolak fibers, the stability of the resin is used to advantage. In the case of resoles, the compositions in solution do not allow the two operations to be separated and the formation of fibers must therefore take place at the same time as the processes of cross-linking and drying which lead to the formation of "stabilized" fibers.

The term "stabilized" is used in the present description to denote fibers which are sufficiently developed to enable them to preserve their own form even if they have not yet attained the final mechanical properties of the completely cross-linked fibers. Moreover, their surface condition is such that they are not liable to stick together when they are gathered together and therefore in contact with one another. The "stability" of the fibers is, of course, related to the conditions under which they are prepared. In the course of this production, the fibers are subjected only to limited mechanical stresses, as will be seen hereinafter.

In other words, the preparation of resole fibers is subject to contradictory requirements. On the one hand, it would seem desirable to prepare a mixture capable of accelerating the process of development while on the other hand, if such a mixture is effectively obtained, it is difficult to control the development of the mixture sufficiently to keep it under conditions suitable for its passage through a bushing and attenuation of the fibers.

In order that the compositions used according to the present invention may be fiberized and bearing in mind their rapid development towards a state in which they can no longer be used for the formation of fibers, it is necessary to arrange for the formed mixture to be used very rapidly.

SUMMARY OF THE INVENTION

According to the present invention, therefore, the mixture is formed at the rate at which it is being used. Once the mixture has been prepared, the means used for producing the fibers should only retain this mixture for as short a time as possible.

The choice of a process using a centrifuge serving as bushing conforms satisfactorily to these conditions.

The quantity of composition held in the centrifuge may be extremely small. It may correspond to the quantity passing through the centrifuge in a few seconds so that the average dwell time will be very brief and there will be no risk of the composition "congealing" before it passes through the orifices.

Once the fibers have been projected from the centrifuge, they must be stabilized as quickly as possible. The time interval separating the appearance of the fibers at the outlet of the centrifuge and their deposition on the collecting device is necessarily limited by the dimensions of the installation employed.

To achieve stabilization of the resin, the fibers must be both dried and cross-linked during this short interval of time. For these two processes, it is advantageous to heat the air surrounding the centrifuge but at a limited treatment temperature. Even if the fibers are not strictly speaking "thermoplastic" as are novolak fibers which have not been cross-linked, they are nevertheless sensitive to heat. It will be seen below that this property is used to advantage for superficially "remelting" the fibers and thus carrying out a so-called self-bonding. The intensity of the heat treatment which the fibers are capable of sustaining is limited mainly by the risk of formation of blisters due to excessively vigorous evaporation of the water or solvents originally present in the composition.

The formation of such blisters is not desirable. They impair the homogeneity of the structure of the fibers and have a significantly deleterious effect on the mechanical properties of the fibers.

For this reason, the temperature of the fibers in the atmosphere surrounding the centrifuge is preferably kept below the boiling point of water or of the mixture of water and solvent present in the composition. For the most useful mixtures, which are described in more detail hereinafter, the temperature not to be exceeded is approximately the boiling point of water. To prevent any risk of formation of blisters, the temperature of the fibers should not exceed 80° C., at least in the region closest to the centrifuge.

The temperature of the atmosphere itself may be substantially higher than that of the fibers in view of the cooling which takes place on the fibers by evaporation. It will be seen in the examples that the temperature of the gas may reach and even exceed 200° C.

A progressive heat treatment may be provided. For example, the fibers may be subjected to a temperature which increases as their distance from the centrifuge increases. Under these conditions, as heat exchange takes place very rapidly due to the fineness of the fibers and cross-linking progresses and the fibers dry, temperatures higher than the temperature limits indicated above may be reached in zones far removed from the centrifuge.

In all cases, the conditions for heat treatment and drying are improved by the circulation of air on the fibers. When the current of hot gas is directed transversely to the direction of projection of fibers from the centrifuge, it is preferably subjected to a relatively low velocity so that the fibers will not be prematurely thrown down over one another before they have stabilized.

It will be seen that under the operating conditions described in detail hereinafter with reference to the apparatus employed, the fibers are kept for only a relatively short time under the conditions favoring their stabilization before they are collected. During this time, which is of the order of a second, stabilization of the fibers is achieved by virtue of the conditions of treatment described above but also as a result of a particularly suitable choice of the compositions.

The conditions to be observed in this respect are primarily linked to the nature of the resin but also depend to a lesser extent on the other components of the mixture.

Firstly, the resin or the mixture of resin and catalyst should have a suitable viscosity for the method of formation of fibers envisaged. Experimentally, taking into account the possible variations in centrifugal force and in the dimensions of the orifices of the centrifuge, a viscosity of the order of 5 to 300 Po and preferably from 15 to 100 Po is advantageously chosen. Under these viscosity conditions, the resin or mixture is neither too fluid, which would cause premature rupture of the filaments, leading to the formation of droplets and/or insufficiently attenuated products, nor to viscous, which would necessitate the use of relatively large orifices and result in fibers which would not have the characteristics of fineness normally required.

The viscosity of the composition used is determined in the first place by the viscosity of the resin, which in turn depends upon the method employed for preparing the resin. It is therefore necessary to take into account the reaction time and reaction temperature, together with the mole ratio of formaldehyde to phenol and condensation should be stopped when a suitable viscosity for spinning has been reached. The viscosity of the resin may, however, be modified by the addition of solvents. The resin used preferably has a molecular mass of from 100 to 1000 and more particularly from 400 and 800. The resin is advantageously prepared from formaldehyde and phenol introduced in a mole ratio of formaldehyde to phenol between 1.3 and 1.7.

When a catalyst is used in the preparation of the composition, its influence must be taken into account.

It is normally introduced in the form of a solution, in particular an aqueous solution.

The resoles are not readily miscible with water. If a homogeneous mixture is to be obtained, which is indispensible for regularity of fiberization, a third solvent is advantageously used, in as small a quantity as possible. The third solvent used is a compound which is miscible both with water and with the resin and may easily be removed in the course of the subsequent treatment of the fibers. The third solvent is advantageously an alcohol, in particular methanol.

The viscosity of the substance added to the resin may also be adjusted so as to ensure that at the moment of mixing, no excessive change in viscosity will take place.

If the activity of the catalyst is required to be reduced, this may be achieved by simultaneously introducing thickening agents, e.g. glycols, preferably di- or triethyleneglycol. Instead of reducing the catalyst activity by dilution with water, which not only increases the fluidity of the mixture too much but also requires the presence of a large quantity of third solvent, it is preferable to introduce these thickening agents, which not only enable a higher final viscosity to be obtained but also improve homogenization of the mixture.

The cross-linking catalysts used are strong mineral or organic acids, either in the form of a single acid or of a mixture. It is preferable to use acids such as sulphuric acid, phosphoric acid or hydrochloric acid or mixtures thereof in aqueous solution.

The use of a catalyst in solution facilitates dispersion of the catalyst in the resin, provided miscibility has been ensured as indicated above. Dispersion of the catalyst in the resin is one element which determines the manner in which cross-linking takes place. Good dispersion promotes rapid and homogeneous cross-linking, which is desirable under the conditions employed according to the invention.

The characteristics of the spinnable compositions used according to the present invention maybe further modified to improve the formation and attenuation of the fibers.

It is known to use, for this purpose, small quantities (less than 2%) of very long chain polyoxyolefines, which facilitate attenuation of the fibers without rupture, even for extremely small diameters. Products of this type include, for example, those known commercially under the name of "POLYOX".

In processes for the formation of fibers from synthetic resins, it is also customary to add small proportions of a surface-active agent, both to improve the characteristics at the time of fiberization and in particular to prevent premature capillary rupture.

These surface-active agents are preferably non-ionic, such as fatty alcohols of sorbitan, or cationic surface active agents, which have greater stability in an acid medium. Preferred surface-active agents are those marketed under the names of "TWEEN" and "SPAN". They are introduced into the composition in proportions of 0.5 to 3% by weight.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
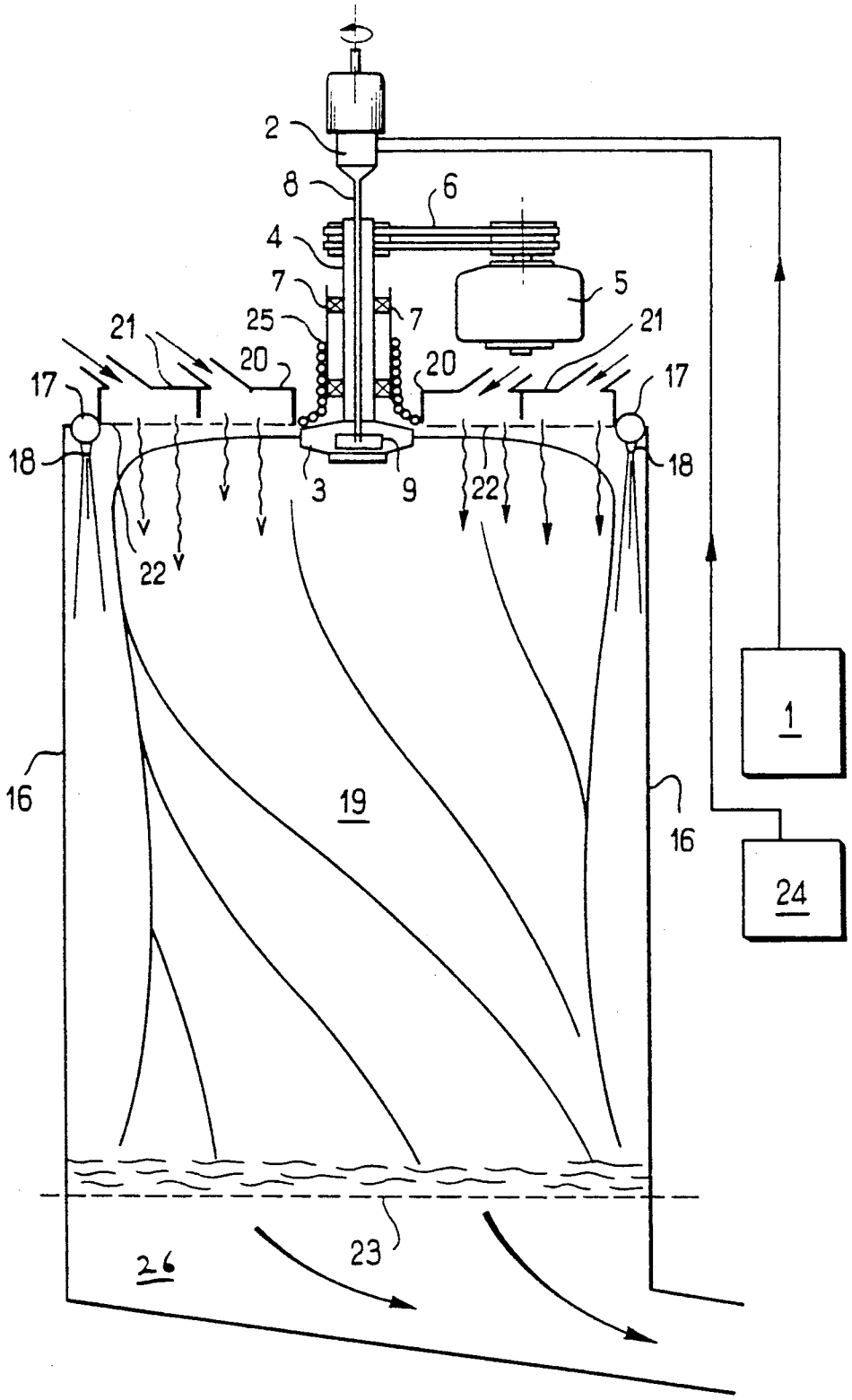
FIG. 1 is a schematic view, partially in section, of an installation for the formation of fibers according to the invention.

The installation shown in FIG. 1 is particularly representative of those which may be used according to the present invention. It is used for conditioning the composition, fiberizing this composition and stabilizing the fibers formed.

The previously prepared resin, possibly containing various fiberization additives, is introduced into a reservoir 1 in which it is maintained at a suitable temperature for preserving it.

The resin in the liquid state, removed from reservoir 1 by suitable devices, such as a pump, screw, etc., is fed in a predetermined quantity into a mixer 2. Into the mixer may also be introduced measured quantities of catalyst from a reservoir such as that indicated at 24.

Mixing is carried out very vigorously in order to produce as homogeneous a composition as possible.

The volume provided in the mixer is small so that the composition will remain therein for as short a time as possible. The composition is then conducted directly into the centrifugation apparatus.

In order to reduce the time elapsing between the process of mixing and formation of the fibers, the pipe 8 carrying the composition to be fiberized into the centrifugation apparatus is also as short as possible. In other words, the mixer 2 is advantageously situated close to the centrifugation apparatus.

Figure 2:
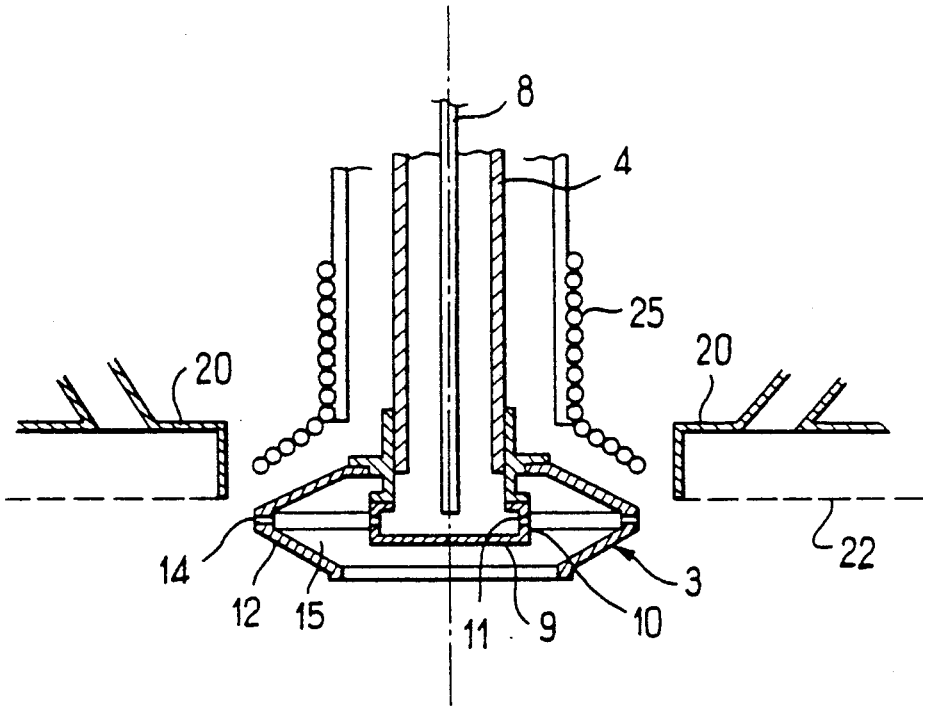
FIG. 2 is a sectional view showing the structure of a centrifuge used according to the invention.

Formation of the filaments from the composition can be carried out in a centrifugation apparatus illustrated in FIGS. 1 and 2.

The apparatus comprises a centrifuge 3 fixed to a shaft 4 which is rotated by an electric motor 5 by way of drive belts 6. The shaft 4 is mounted on roller bearings 7.

The shaft 4 is hollow. The pipe 8 carrying the composition to the centrifuge is seated in this shaft.

The centrifugation apparatus includes a basket 9 arranged so that the composition is poured on the bottom of the basket. The peripheral wall 10 of the basket is perforated by evenly spaced orifices 11.

Under the effect of rotation, the composition reaches the internal surface of the wall 10 and escapes through the orifices 11 in the form of coarse threads, which are projected onto the peripheral wall 12 of the centrifuge proper 3.

The presence of the basket 9 provides for an initial equalization in the distribution of the composition over the internal surface of the peripheral wall of the centrifuge. The larger the centrifuge, the greater is the advantage of using a basket. In a centrifuge of large diameter, the so-called "natural" distribution of the composition is liable to become unbalanced. It is very important for the quality of the fibers to ensure that the same "reserve" will be available at every point of the centrifuge, that is to say the same thickness of the layer of composition so that the conditions of centrifugation will be everywhere the same and hence the fibers will be formed under identical conditions.

The composition which forms the reserve escapes from the centrifuge 3 through the orifices 14 situated at the periphery. The orifices 14 are of such a dimension that each of them forms a single fiber, which is afterwords projected into the surrounding atmosphere.

The internal profile of the centrifuge is designed to facilitate the flow of the composition. In the form illustrated in FIG. 2, the orifices are preceded by a sloped part 15 which is triangular in section, conducting the composition to the orifices 14. This profile in particular prevents stagnation of the composition in dead areas, which could result in the deposition of cross-linked resin.

Figure 3:
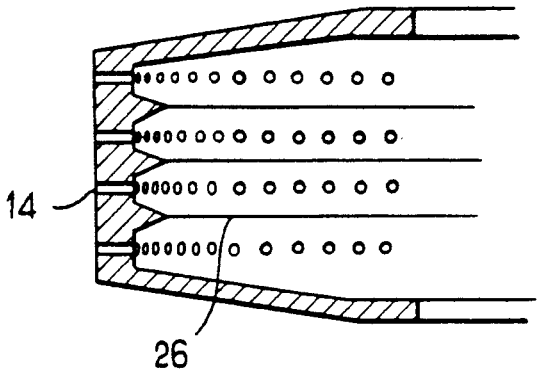
FIG. 3 is a partial sectional view of a centrifuge having a plurality of rows of orifices.

FIG. 2 shows a centrifuge having a single row of orifices 14, but the centrifuge could also have several rows of orifices, as shown in FIG. 3. In that case, the distance between two successive rows of orifices should be so chosen that the fibers formed are not liable to stick together before they have stabilized. The distance between two orifices of a given row is also chosen so that the fibers do not stick together.

The profile of the centrifuge having several rows of orifices as shown in FIG. 3 also includes grooves 26 on its internal surface, which grooves diminish in cross-section as they approach the orifices 14 and provide for good circulation of the material to be fiberized towards each row of orifices.

The quantity of composition in the basket and the centrifuge is kept to the minimum necessary to maintain a continuous supply to the orifices 14. To ensure the quality and regularity of the fibers, the "reserve" should suitably cover the orifices 14 but at the same time this reserve should be kept small in quantity so as to reduce the dwell time.

In practice, when the operating conditions are well established, the time between the beginning of the process of mixing the components of the composition and formation of the fibers as the mixture passes through the orifices 14 of the centrifuge may be less than one minute and even as short as about 10 seconds. Under these conditions, the time available for development of the mixture is insufficient for this development to constitute an obstacle to fiberization, even if the cross-linking reaction follows a rapid course.

The composition is projected from the centrifuge in the form of filaments whose dimensions are determined by those of the orifices. Bearing in mind the viscosities of the composition indicated earlier and the requirement to obtain fine fibers of the order of 20 microns or less, the orifices advantageously have a diameter of less than 1 mm and preferably from 0.2 to 0.8 mm. If larger diameters are used, the other conditions remaining unchanged, the fibers produced are thicker. If finer fibers are nevertheless to be obtained, it is then necessary to carry out more vigorous centrifugation and/or reduce the rate of flow of composition for each orifice.

The fibers are initially projected and attenuated substantially in a plane perpendicular to the axis of rotation of the centrifuge. They develop in spirals which may extend over relatively long distances from the centrifuge if the initial acceleration is high. The path of the fibers in the plane, which may attain one meter or more, is normally limited due to obstruction by the preferably cylindrical receiver 19 within which the centrifuge is positioned.

In the case illustrated, the path of the fibers is limited by blowing a gas current downward along the walls 16 of the receiver with sufficient intensity to beat down the fibers before they reach the walls. This gas blast may be produced, for example, from a series of nozzles 18 placed along a pipe 17 conducting air under pressure. The nozzles 18 are preferably sufficiently close together to enable the separate jets to fuse very rapidly and form a virtually continuous sheet of gas which obstructs the passage of fibers.

The modification of the path of the fibers by the gas current along the wall 16 introduces certain turbulences into the movement which up to that point has developed in a very regular fashion. Stroboscopic investigation shows that in their path up to the vicinity of the wall 16, the spirals of fibers develop very regularly. In other words, at this stage of their formation, the fibers remain clearly separated as they progress. The treatment according to the invention, which results in stabilization of the fibers, begins in the course of this progression.

From the beginning of their path towards the wall 16 of the receiving container 19, the fibers are subjected to a heat treatment which substantially accelerates the kinetics of cross-linking of the mixture and facilitates removal of the water and/or solvent present in the fibers.

The heat treatment is advantageously carried out by means of hot gas currents placed in the path of the fibers, between the outlet of the centrifuge and the point where the fibers are thrown down by the gas blast from the nozzles 18. The hot gas currents are directed in the path of the fibers with such a speed and a temperature as to modify the path as little as possible and consequently minimize the risk of fibers sticking together when they are not yet stabilized.

The function of this gas is primarily to maintain the fibers at a suitable temperature for cross-linking and drying. Due to the low thermal inertia of fibers as fine as those obtained, heat exchange is virtually instantaneous, no matter what the speed of circulation of the gas.

To prevent any significant modification in the path of the fibers, the velocity of the heated treating gas is preferably kept below 20 m/sec.

It has already been indicated above that it may be advantageous to subject the fibers to differing temperature conditions along their path. FIG. 1 shows a double supply of hot gas. The gas is supplied from chambers 20 and 21 placed at the top of the receiver at positions concentrically around the centrifuge. The chambers 20 and 21 are supplied from one or more gas burners through pipes (not shown). The chambers are separated from the interior of the receiver 19 by perforate grids 22 which have low restriction characteristics to enable gas to flow through at a low speed.

The installation illustrated comprises two such emission chambers 20 and 21 for hot gas and it should be understood that the temperature of the gas in these two chambers may be regulated independently of one another. A larger number of gas emission chambers could be provided for even better control of the progress of the treatment conditions of the fibers.

It is preferable to arrange the device so that the gas emitted in the path of the fibers by chambers 20 and 21 does not come into direct contact with the centrifuge 3. This is because it is necessary to avoid any heating effect which could result in premature modification of the composition in the centrifuge 3.

It may also be advantageous for the same reason to protect the centrifuge against the heat from the adjacent chamber 20 by interposing, for example, a coil 25 surrounding the shaft 4 and the top of the centrifuge and circulating cooling water through this coil.

The length of the path necessary before the fibers are collected together is determined separately for each composition treated at the same time that the temperature conditions of the gas are determined, since it is necessary in each case to collect the fibers in a sufficiently dry and cross-linked state to ensure that they will not stick together.

The fibers carried by the gas are deposited on a conveyor belt 23, where they form a sheet of matted fibers.

The distance separating the centrifuge from the receiving conveyor belt 23 is preferably such that the time taken by the fibers to cover this path is from 0.1 to 2 seconds.

In addition to the chambers 20 and 21 from which the hot gases are introduced, the temperature conditions and circulation of the fibers may be modified by providing openings in the wall 16 of the container 19 to admit the surrounding air. In that case, the air enters the chamber under the effect of the partial vacuum which is maintained by suction of the gas under the conveyor. The suction means consist of a plenum 26 placed under the perforate conveyor 23, and a suction pump (not shown).

The conditions according to the invention indicated above enable fibers to be collected in a very advanced cross-linked stated within a very short time. If the complete dwell time of the fibers in the receiver is very short, the fibers may not have reached a sufficient degree of maturation (or cross-linking) to enable them to acquire the best possible characteristics. In that case, cross-linking is advantageously completed by a very brief subsequent passage through a stove.

Contrary to what is normally found in earlier techniques for the production of novolak fibers, no diffusion of cross-linking agent and/or of catalyst now takes place. This final treatment is solely a heat treatment and may therefore be very brief and above all it may consist of continuous passage of the fibers through a suitable stove.

To accelerate cross-linking, such a heat treatment may advantageously be carried out at a temperature above 100° C., preferably at 100° to 150° C.

Under these conditions, a treatment lasting 5 minutes or less is normally sufficient.

In the course of this heat treatment, if the fibers have maintained a certain thermoplasticity although their cross-linking is highly advanced, they may be subjected to a brief rise in temperature above their softening temperature so as to bond them to one another.

This operation is advantageously carried out at a temperature of from 200° to 240° C., and a fiber having fixed dimensional and mechanical characteristics may thus be obtained.

EXAMPLE OF PREPARATION OF FIBERS IN THE PRESENCE OF A CATALYST

1. Preparation of the Basic Resin 1270 mols of phenol (99.5% pure) and
1330 mols of water
are mixed in a temperature regulated 200 l reactor. The mixture is heated to 50° C. and
1905 mols of paraformaldehyde (96% pure) and
30 mols of sodium hydroxide (50% solution)
are added.

The temperature is raised to 60° C. within 15 minutes and this temperature is maintained for 30 minutes. The temperature is thereafter raised to 98° C. in 55 minutes. The mixture is maintained at this temperature for 30 minutes and the temperature is finally adjusted to 80° C.

The reaction is stopped by cooling when the desired viscosity has been reached. This is measured by the method of flow through a tube. The reaction is stopped by cooling to 25° C.

The resin obtained has a viscosity of 10 poises at 25° C. The dry extract constitutes 70.5% of its weight. The resin is preserved at a temperature of 5° to 7° C.

2. Preparation of the Premix 15 kg of the resin obtained under step 1 is heated to 20° C. in a 25 l vat equipped with a reversible, 6-blade stirrer.

0.225 kg of the surface active agent known commercially as "SPAN 20" (ATLAS C°) are added with slow stirring.

A previously prepared mixture of 0.225 kg of fiberizing agent marketed under the same name of "POLYOX WSRN 3000" (UNION CARBIDE) dispersed in 1.5 kg of methanol is then added with rapid stirring (800 revs/-min).

Stirring is then maintained at 100 revs/min for 6 hours. The viscosity of the premix which is capable of being fiberized is 130 poises at 25° C.

3. Preparation of the Catalyst 4.507 kg of sluphuric acid (92.5%), 1.765 kg of phosphoric acid (purity 85%) and 0.295 kg of water are mixed in a temperature regulated, 1.5 l reactor and stirred. Mixing is carried out at about 50° C.

3.432 kg of triethylene glycol are added after cooling.

4. Preparation of the Mixture to Form the Fibers

This is carried out in an installation which allows for continuous mixing of the premix and catalyst. This installation is situated close to the fiber forming apparatus.

It comprises:

A double walled vat regulated at 20° C., from which the premix is removed by a gear wheel dosing pump, an enamelled vat from which the catalyst is formed by a dosing pump having three pistons placed at intervals of 120° to provide a uniform feed rate, a mixer consisting of a toothed rotor rotating in a toothed stator at a speed of from 500 to 1000 revs/min.

For 100 parts of mixture, the catalyst is added in 7 parts.

The mixture used to form the fibers consists, according to requirement, of 100 parts by weight of resin premix with 5 to 10 parts of catalyst.

This mixture is obtained in a homogeneous form with a viscosity varying from 35 to 50 Po at 25° C.

5. Formation of the Fibers

This operation is carried out continuously in a square sectioned container having a height of about 2.5 m, of the type illustrated in FIG. 1.

The mixture obtained in step 4 is conducted by a pipe from the mixer to the receiving basket. The centrifuge and basket rotate at 3000 revs/min. The basket is perforated by 40 apertures 1.2 mm in diameter while the centrifuge, which has a diameter of 200 mm, has 150 apertures each 0.5 mm in diameter.

6. Drying and Cross-Linking

The fibers spread out in air ejected from five concentric chambers.

The velocity of the gas emitted from these chambers increases with the distance from the centrifuge, thus ensuring progressive deflection of the fibers.

The air is heated to a temperature adjusted to 150° to 160° C.

A certain quantity of air at ambient temperature is introduced through the walls forming the sides of the container.

The temperature of the air is 80° C. at the level of the receiving conveyor.

The fibers are deposited in a continuous sheet about 50 cm in width formed by long fibers which are dry and to a large extent cross-linked.

The degree of cross-linking may be varied by adjusting the suction to control the temperature at the bottom of the basket.

7. Characteristics of the Fibers in the Sheet

At an output of composition of 255 kg/day, the quantity of fibers recovered is 166 kg/day.

The diameters of the fibers are from 2 to 19 μm. The histogram of the diameters is of a very restricted, gaussian type with an average diameter of 7 micrometers.

The average resistance to traction is established at about 300 MPa.

The volumetric mass of the sheet is approximately 20 $kg/m^3$ and its thermal conductivity is of the order of 35 mW/m°K. for a thickness of 80 mm.

The fibers originally obtained may be completely cross-linked by passage through a stove at 120° C. for 5 minutes.

Fibers which have not been completely cross-linked may present a certain thermoplasticity. This may be used to advantage to form a self-bonded sheet. For this purpose, the sheet obtained is subjected to a temperature of the order of 220° C. for 3 minutes under slight compression.

The sheet thereby obtained has a cohesion which enables it to be easily handled.

EXAMPLE 2

The same conditions are employed as before but using a centrifuge having several rows of orifices as shown in FIG. 3.

Formation of the fibers is carried out by rotating the system at 3800 revs/min. The basket 9 is perforated by six apertures 2.5 mm in diameter and the centrifuge has four rows of 150 apertures, 0.4 mm in diameter.

The general conditions of drying and cross-linking are unchanged. Good distribution of the threads of fibers in both horizontal and vertical planes is observed.

The output of stabilized fibers obtained is advantageously higher than that obtained with a single row of orifices.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the formation of resole type phenoplast fibers, said process comprising the steps of:

combining formaldehyde and phenol with a mole ratio of formaldehyde to phenol which is greater than one so as to form a liquid composition;

continuously treating small quantities of said composition by adjusting a viscosity of said composition and by conditioning said composition to be chemically cross-linked, including the addition of a cross-linking catalyst, said continuous treatment being applied to said composition at the rate at which it is being used;

immediately after said continuous treatment step, feeding said treated composition into a centrifuge bushing having a plurality of orifices;

continuously extruding said composition through said orifices to form fibers and projecting said fibers into a surrounding atmosphere wherein said composition extruded from each said orifice forms one said fiber whose dimensions are determined by those of said orifices and each said projected fiber is attenuated;

selecting said constitutents and a degree of conditioning of said composition, and selecting characteristics of said surrounding atmosphere, such that cross-linking and drying of said projected fibers by said atmosphers begins as soon as said fibers are projected out of said centrifuge and is operated;

treating said projected fibers in said atmosphere by a degree sufficient such that said fibers are stabilized to the extent that they are solid and will not stick together and are at least partially cross-linked, and collecting said projected fibers.

2. The process of claim 1, wherein the viscosity of said composition is adjusted to a value from 5 to 300 Po.

3. The process of claim 2, wherein the viscosity of said composition is adjusted to a value from 15 to 100 Po.

4. The process of claim 1 in which the time elasped between said step of conditioning said composition and said extruding step is not greater than one minute.

5. The process of claim 1 in which said atmosphere in a path of said projected fibers is heated by hot gas currents.

6. The process of claim 5 in which said hot gas currents blow at a speed not greater than 20 m/sec.

7. The process of claim 5 or claim 6 in which said hot gas currents possess a temperature sufficiently low to prevent sticking of said fibers.

8. The process according to claim 1 or claim 6, wherein in said step of treating said projected fibers, said treatment is such that a temperature of said projected fibers in said atmosphere is maintained below that at which blisters appear in said fibers.

9. The process of claim 8, wherein in said step of treating said projected fibers, said treatment is such that said projected fibers are maintained at a temperature no higher than 80° C.

10. The process of claim 9, wherein said step of treating said projected fibers lasts from 0.1 to 2 seconds.

11. The process of claim 1, wherein said catalyst consists of an aqueous solution composed of at least one from the group consisting of sulphuric acid, hydrochloric acid and phosphoric acid.

12. The process of claim 11, in which said catalyst solution includes methanol to improve the miscibility thereof.

13. The process of claim 1, wherein one of said steps of continuously treating and combining includes the addition of a fiberizing agent consisting of a long chain polyoxyolefine into said composition.

14. The process of claim 1 or claim 13, wherein one of said steps of continuously treating and combining includes the addition of a surface active agent into said composition.

15. The process of claim 1 or claim 5 or claim 14 wherein said fibers which have been treated in said atmosphere are further subjected to a heat treatment at a temperature below the point of residual softening for a time not exceeding 5 minutes.

16. The process of claim 15, in which said further heat treatment is carried out at a gas temperature of from 100° to 150° C.

17. The process of claim 1 or claim 5 or claim 14 wherein said fibers collected in the form of a sheet are subjected to a heat treatment at a temperature above the point of residual softening.

18. The processing of claim 17, in which the heat treatment is carried out at a temperature of from 200° to 240° C.

* * * * *